US005603232A

United States Patent [19]

Throneburg

[11] Patent Number: 5,603,232

[45] Date of Patent: Feb. 18, 1997

[54] FOOT PROTECTOR FOR USE IN COMBINATION WITH HOSIERY AND METHOD OF MAKING AND USING SAME

[76] Inventor: James L. Throneburg, 625 W. Bell St., Statesville, N.C. 28687

[21] Appl. No.: 562,163

[22] Filed: Nov. 22, 1995

[51] Int. Cl.[6] ..... A41B 11/02; D04B 9/46

[52] U.S. Cl. ..... 66/185; 66/178 R; 2/239

[58] Field of Search ..... 66/178 R, 169 R, 66/171, 185, 172 R; 2/239

[56] References Cited

U.S. PATENT DOCUMENTS

| | | | |
|---|---|---|---|
| 1,727,586 | 9/1929 | Condon . | |
| 1,889,716 | 11/1932 | Walker . | |
| 2,904,980 | 9/1959 | Stinson | 2/239 X |
| 3,143,870 | 8/1964 | Smith | 2/239 X |
| 3,146,468 | 9/1964 | McDonald | 2/239 |
| 3,562,818 | 2/1971 | Burton | 2/239 |
| 3,796,067 | 3/1974 | East . | |
| 3,990,115 | 11/1976 | Nester | 2/239 |
| 4,169,324 | 10/1979 | Gibbs | 2/239 X |
| 4,194,249 | 3/1980 | Thorneburg . | |
| 4,253,317 | 3/1981 | Howard et al. . | |
| 4,255,949 | 3/1981 | Thorneburg . | |
| 4,263,793 | 4/1981 | Safrit et al. . | |
| 4,277,959 | 7/1981 | Thorneburg . | |
| 4,341,096 | 7/1982 | Safrit et al. . | |
| 4,373,361 | 2/1983 | Thorneburg . | |
| 4,615,188 | 10/1986 | Hursh et al. . | |
| 4,732,015 | 3/1988 | Abrams et al. . | |
| 5,307,522 | 5/1994 | Throneburg et al. . | |
| 5,325,541 | 7/1994 | Willard . | |
| 5,335,517 | 8/1994 | Throneburg et al. . | |
| 5,428,975 | 7/1995 | Lee, III et al. | 66/178 R |

*Primary Examiner*—John J. Calvert

*Attorney, Agent, or Firm*—Bell, Seltzer, Park & Gibson, P.A.

[57] ABSTRACT

A foot protector for use in combination with stocking-type hosiery to cushion and protect a wearer's foot is described. The foot protector is preferably knit to include padding in the form of integrally knit terry loops, and has a specially constructed top portion for encircling the wearer's ankle. The top portion extends upwardly to a greater extent proximate the wearer's heel than the instep, and is substantially unpadded. When the foot protector is worn in a layered relationship with a stocking and a shoe, the protector is only minimally visible, if at all, thereby providing enhanced wearer comfort while maintaining the appearance of wearing stockings and shoes alone.

22 Claims, 3 Drawing Sheets

FOOT PROTECTOR FOR USE IN COMBINATION WITH HOSIERY AND METHOD OF MAKING AND USING SAME

FIELD OF THE INVENTION

This invention relates generally to a foot protector and more specifically to footlet-type foot protectors for use in combination with stocking-type hosiery to cushion and protect a wearer's feet.

BACKGROUND OF THE INVENTION

As a function of their employment, many people are forced to be on their feet all day, either standing or walking. As a result, they tend to become fatigued quickly and their feet can become sore and swollen. In addition, a person's shoes, which may initially be comfortable, can become uncomfortable and cause blisters or callouses following extended periods of wear. As the majority of wearer's weight is typically carried on the ball and heel portions of his or her feet, these areas can tend to become particularly sore and prone to blistering and the formation of callouses.

Medical personnel such as nurses and medical technicians, in particular, are often on their feet for extended periods of time without an opportunity to sit down. Such medical personnel typically wear uniforms which include opaque (typically white) stocking-type hosiery and similarly colored shoes, which are usually of the saddle oxford or tennis shoe varieties. Despite the initial comfort of these shoes and their low heels, the wearer's feet can still tend to become sore and tired after extended periods of standing. Further, the stocking-type hosiery typically worn by these medical personnel is conventionally made of nylon or other hydrophobic fibers. Due to the lack of moisture absorption by these hydrophobic fibers, the wearer's foot discomfort tends to increase as their feet perspire because the perspiration produced tends to remain adjacent the person's skin. Further, the moisture tends to exacerbate the rubbing of their shoes against their feet, and therefore promotes the formation of blisters.

Prior art developments in the way of articles to be worn on the foot in combination with stocking-type hosiery have tended to focus on protection of the stockings rather than the enhancement of the comfort and protection of the wearer's feet. For example, U.S. Pat. No. 1,727,586 to Condon and U.S. Pat. No. 1,889,716 to Walker both disclose footlets adapted to be worn under hosiery to protect the same. Each of these stocking protectors fails to provide any cushioning protection for the wearer's feet, and these types of stocking protectors are designed to be as thin as effectively possible in order that they may readily fit beneath the wearer's stockings and inside the wearer's shoes. Further, these stocking protectors are designed to cover only the minimal portions of a wearer's foot necessary to appropriately protect the stockings. The Condon stocking protector is designed to only cover the portions of a wearer's foot at which the stocking is subject to damage, namely the toe and the heel. The Walker stocking protector, on the other hand, is designed to only cover the foot adjacent the wearer's toes.

It has also been known to provide socks having increased cushioning about certain areas of a wearer's foot, as shown for example in the commonly assigned U.S. Pat. No. 5,335,517 to Throneburg, et al. The sock described in that patent utilizes varying thicknesses of terry cushioning to provide comfort to a wearer's foot. Similarly, U.S. Pat. Nos. 4,615,188 to Hursh, et al. and 3,796,607 to East describe socks providing cushioning to a wearer's feet. The socks disclosed in the Hursh, et al. and East patents have two-ply constructions in order to provide greater cushioning to the wearer's feet. Commonly assigned U.S. Pat. No. 4,194,249 to Thorneburg discloses an athletic sock having terry loops concentrated in selected areas to form padded shock absorbing regions for a wearer's feet. In an embodiment of the athletic sock which has a rolled top portion, the terry loop padding continues from the foot portion of the sock onto the rolled top portion. Though padded socks can provide comfort to a person's feet, they have typically been unavailable for use by many medical personnel and the like, whose uniforms require the wearing of nylon type stockings.

Therefore, a need exists for a means for providing cushioning comfort to a wearer's feet while the person wears stockings and for providing wearer comfort while maintaining an aesthetically appealing appearance.

In addition, a need exists for a means of enhancing the comfort of a person's feet when the person is to be on his or her feet for long periods of time, and for dealing with the discomfort associated with the accumulation of perspiration within a person's shoes.

Further, a need exists for comfort-enhancing foot protectors for use in combination with stocking-type hosiery which readily maintain their positions relative to the wearer's shoes, hosiery, and feet.

Likewise, a need exists for a method of making and using foot protectors which provide cushioning comfort and protection for a wearer's feet when used in combination with stocking-type hosiery.

OBJECTS AND SUMMARY OF THE INVENTION

With the foregoing in mind, it is an object of the present invention to provide foot protectors which can be used in combination with hosiery in order to cushion and protect the feet of a wearer.

It is a further object to provide a foot protector which protects the foot of the wearer while allowing an aesthetically appealing appearance.

Another object is to provide a footwear combination which provides the appearance of conventional stocking-type hosiery when worn with a shoe, while providing cushioning comfort and protection for the wearer's feet.

It is a further object of the present invention to provide methods for making and wearing a foot protector adapted to be positioned in a layered relationship with an item of stocking-type hosiery to provide comfort to a wearer's feet while maintaining an aesthetically appealing appearance.

These and other objects are accomplished by providing a footlet having thickened cushioning portions and a specially constructed top portion which facilitates the maintenance of the footlet in a desired position on a wearer's foot. The specially configured pad structure of the foot protector of the present invention enables the foot protector to be worn in combination with stocking-type hosiery to provide cushioning comfort to a wearer's feet. In addition, the specially structured top portion of the foot protector, which preferably terminates proximate or below the wearer's ankle, enables the wearer to utilize the protector in a layered relationship with an item of stocking-type hosiery and shoes, while maintaining substantially the appearance of wearing stockings and shoes alone.

More particularly, a foot protector is provided for wearing on a foot of a wearer. The foot protector desirably includes padding in selected regions thereof, in order to provide cushioning comfort to a wearer's feet. Because ball, heel and toe areas of a foot generally receives a majority of the pressures and forces experienced by the foot, the padding is preferably provided on toe, ball and heel portions of the foot protector to concentrate cushioning where most needed.

The foot protector preferably is a knit footlet having thickened padding areas provided in the toe, ball, arch, heel, and instep portions. More particularly, in a preferred embodiment of the invention, padding having a first thickness is provided in the instep and arch portions of the foot protector, and padding having a second thickness which is greater than the first thickness is provided in the toe, ball, and heel portions. Side panels connecting the opposite sides of the instep portion to a lower sole portion of the foot protector are desirably unpadded, as is the top portion of the foot protector. In this way, varying amounts of padding are provided relative to the amount of forces the particular areas of the foot are expected to encounter when the wearer engages in routine activities such as standing, walking, or the like.

The padding is preferably knit into the foot protector in the form of fed-in yarns which form a plurality of terry loops. The number of loops, number of yarns forming the loops, loop length, loop compactness, and the like can be selected to provide the optimal amount of padding in the respective sections of the foot protector. In this way, the padding can be integrally formed in the foot protector as the protector is being knitted on a knitting machine, such as a conventional sock-making machine. The loops are preferably adapted to intimately contact the skin of the wearer's feet, as the terry loops provide a comfortable surface to the wearer and the loops tend to assist in wicking moisture away from the wearer's feet. In addition, the type of yarns used to form the various sections of the foot protector can be selected to optimize cushioning, durability, moisture absorption, and the like.

The foot protector also preferably includes a specially configured top portion which is adapted to extend circumferentially around the wearer's foot, proximate his or her ankle. This top portion has a first section proximate the instep portion of the foot protector, which extends upwardly from the instep portion a first distance, and a second section proximate the heel portion which extends upwardly from the heel portion a second distance, which is greater than the first distance. As a result, the top portion has an extended length proximate the wearer's upper heel when the foot protector is donned. This configuration of the top portion has been found to securely maintain the foot protector on a wearer's foot, particularly when the foot protector is used in combination with an item of stocking-type hosiery, as will be discussed further herein.

The top portion also desirably includes one or more elastic threads about its terminal end, which assist in the gripping of the top portion about the wearer's foot. Also in a preferred form, the top portion is plain knit with the technical face of the knit fabric forming what is to be the outer surface of the foot protector (i.e. the side opposite the wearer-contacting surface.) This is preferably also the opposite side of the foot protector from that which has the padding thereon. In this embodiment, because its technical face faces outwardly, the top portion exhibits a natural tendency to curl outwardly upon itself to form a protrusion around the open or foot-insertion end of the foot protector. This protrusion can assist in maintaining the foot protector in its desired position on the foot when shoes are donned, because the protrusion tends to abut the upper edge of the shoe and be supported thereon. Because of its unique construction, upon donning the protector, the wearer can position it on his or her foot in a substantially unrolled condition, and it has a tendency to maintain that position while worn.

The extended length of the second section of the top portion is preferably provided in the form of additional knitted courses, and the transition between the first section and section of the top portion is preferably made by way of the provision of a conventional "bird's eye" knit structure at the transition points between first and second sections. As will be recognized, however, different means of transitioning between the differing lengths of the respective sections can be utilized.

The top portion is preferably knit using a base and auxiliary yarn knit together in a plain knit non-terry configuration. In this way, the thickness of the top portion is minimized in order that it is not readily visualizable when it is worn with stocking-type hosiery and shoes, yet sufficient structural integrity is provided for the top portion to maintain its position on the wearer's foot and withstand the extensive forces experienced during donning and doffing of the foot protector. The padded portions of the foot protector are preferably knit using a base yarn and at least one or two auxiliary yarns which form terry loops in the fabrics, with the number of auxiliary yarns depending on the thickness of pad desired.

In wear, the foot protector is preferably donned by the wearer so that the terry loops which desirably form the padded sections face inwardly toward the wearer's feet. Besides assisting with moisture absorption, the loops provide a comfortable cushion for the wearer's feet. An item of stocking-type hosiery, which is preferably made from yarns having a much smaller denier than those used to form the foot protector, is then placed over the foot protector, and the wearer then dons his or her shoes. Because of the configuration of the top portion of the foot protector, the protector is barely visible above the wearer's shoe, if at all. Alternatively, the hosiery can be donned first and the foot protector can be placed over the hosiery. It is preferred, however, to don the foot protector first since yarns used to form the foot protector are typically more comfortable to the wearer's skin and moisture absorbent than those used to make hosiery, and because the appearance of the foot protector tends to be more effectively minimized when it is worn underneath the item of hosiery.

BRIEF DESCRIPTION OF THE DRAWINGS other objects and advantages will appear as the description proceeds when taken in connection with the accompanying drawings, in which.

DETAILED DESCRIPTION

The present invention now will be described more fully hereinafter with reference to the accompanying drawings, in which preferred embodiments of the invention are shown. This invention may, however, be embodied in many different forms and should not be construed as limited to the illustrated embodiments set forth herein; rather, these illustrated embodiments are provided so that this disclosure will be thorough and complete, and will fully convey the scope of the invention to those skilled in the art. Like numbers refer to like elements throughout.

Figure 1:
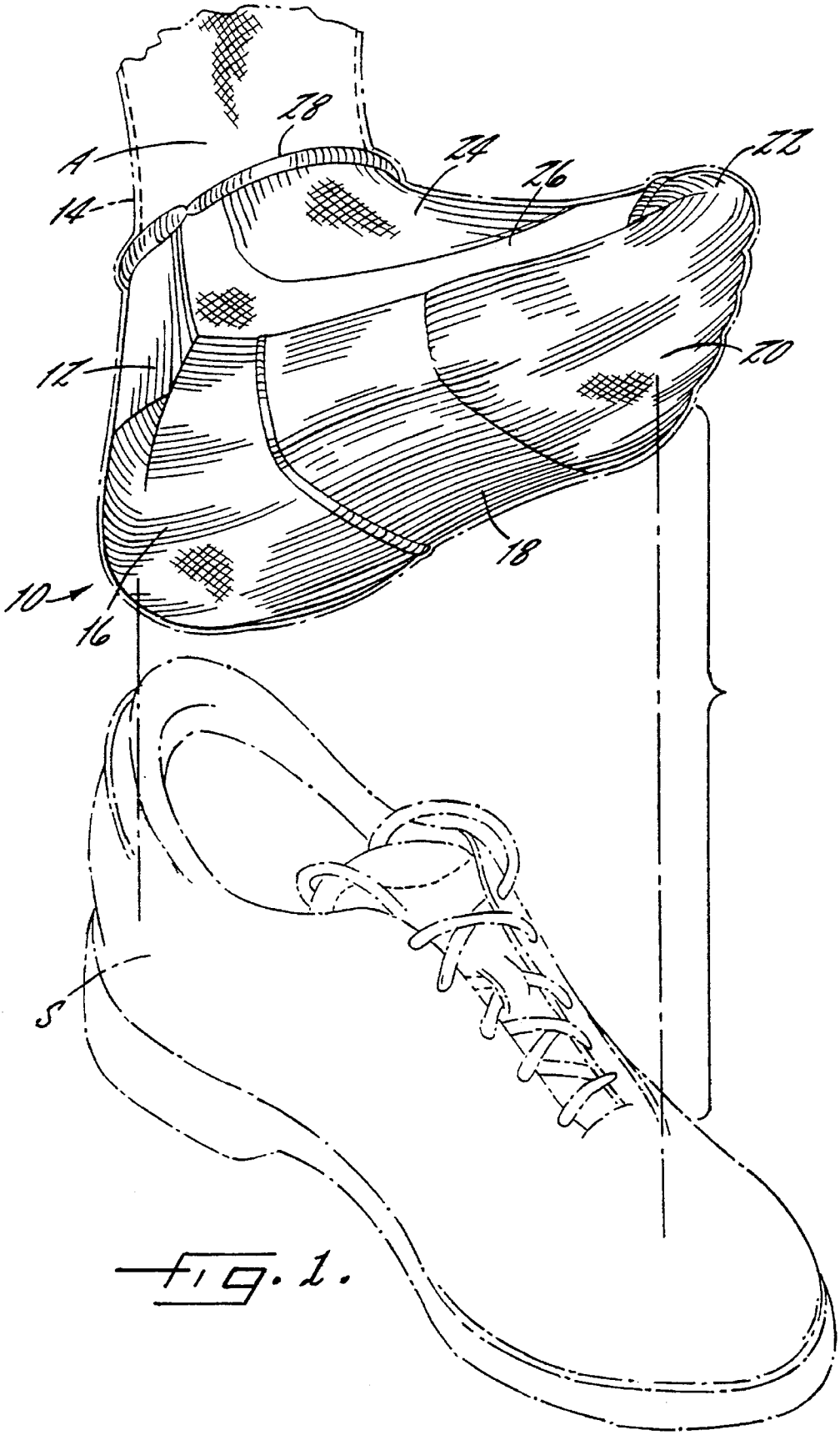
FIG. 1 illustrates a perspective view of a foot of a wearer having a foot protector according to the present invention positioned over the wearer's foot, and underneath hosiery, i.e., stocking-type hosiery, and as it would appear prior to the insertion of the wearer's foot in the illustrated shoe.
Figure 2:
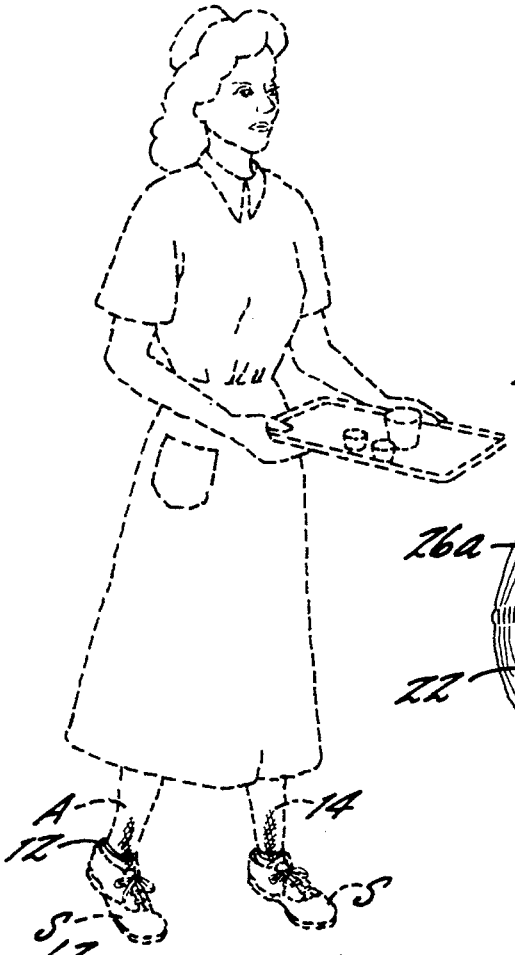
FIG. 2 illustrates an environmental view of a pair of foot protectors according to the present invention as they appear when worn underneath stocking-type hosiery and when the wearer is wearing shoes.

As illustrated in FIGS. 1–2, the present invention relates to a foot protector/stocking combination 10 for providing protection and comfort to a wearer's feet while providing substantially the same appearance as if the wearer were wearing hosiery alone. The combination 10 includes a specially designed foot protector 12 which is worn underneath a stocking 14. The stocking 14 is preferably of the conventional hosiery type, such as the type typically worn by medical personnel and the like. Such stockings are typically knit from yarns in the 20–140 denier range, and preferably extend at least to the mid-calf region of the wearer, and more preferably to proximate the wearer's knee, i.e. in the form of "knee-highs". Alternatively, the stockings can extend to the wearer's thighs, in the manner of "thigh-high" stockings, or all the way to the waist or above, in the manner of pantyhose or body stockings. Though preferred stocking yarn sizes have been specified, it is noted that the foot protector of the present invention is adapted to be used in combination with virtually all types of stocking-type hosiery where foot cushioning and minimal protector visibility would be appreciated, which could include a variety of hosiery styles and those made from a wide variety of yarn sizes. The stockings 14 can be manufactured from conventional types of yarns such as nylon, cotton, spandex and the like, and can be seamless or seamed, sheer or opaque.

As illustrated in FIG. 2, the top portions of the foot protectors 12 are specially constructed so as to be only slightly visible, if at all, over the tops of the shoes S. Therefore, an aesthetically pleasing appearance can be maintained by the wearer using the foot protectors 12 of the present invention, while the wearer's comfort is enhanced. To further minimize the appearance of the foot protectors of the present invention, they can be produced to have colors which correspond to the wearer's skin or the stockings. For example, because medical personnel typically wear white opaque stockings, their foot protectors can be provided in white as well. Alternatively, and particularly for darker skinned wearers wearing light colored stockings, the foot protectors can be provided in a color which approximates that of the wearer's skin; in this way, the appearance of the foot protector can be minimized.

Figure 3:
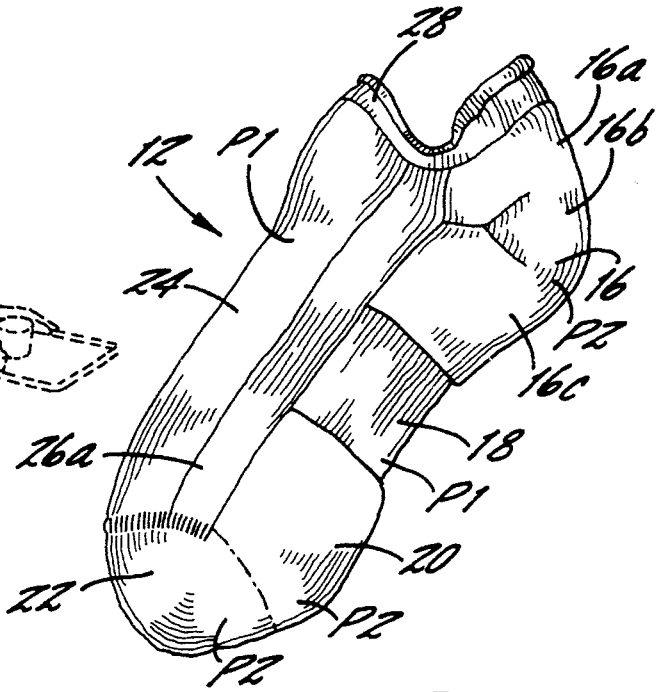
FIG. 3 illustrates a side elevational view of a foot protector according to the present invention.
Figure 4:
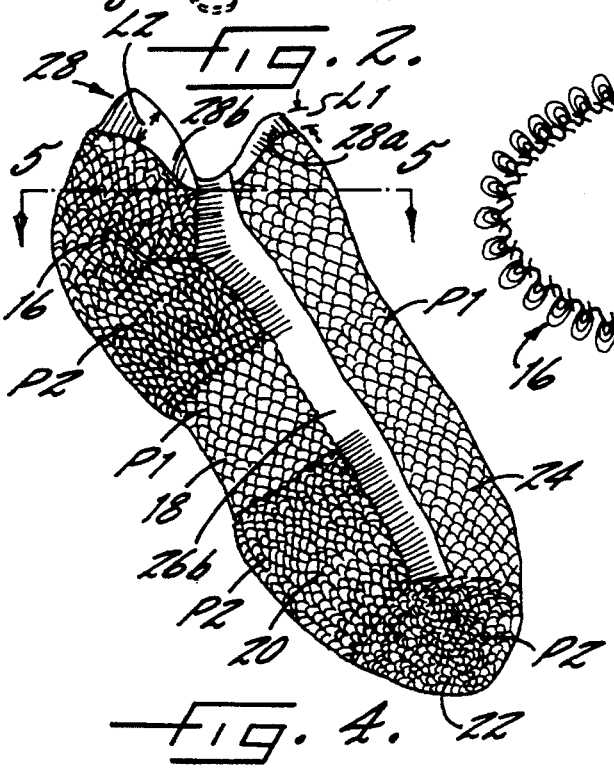
FIG. 4 illustrates a side elevational view of a foot protector according to the present invention in an everted position.
Figure 5:
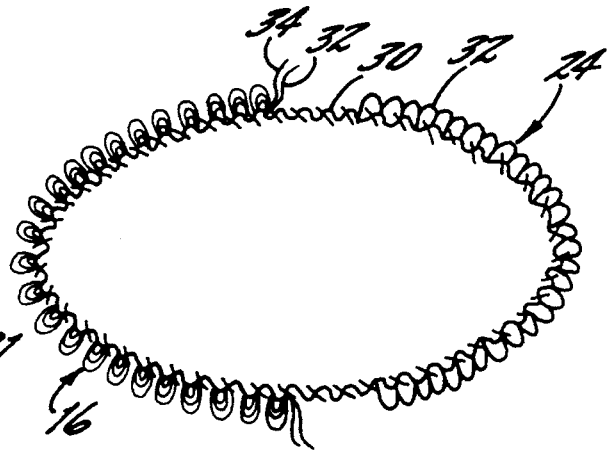
FIG. 5 illustrates an enlarged cross-sectional view of a foot protector according to the present invention taken substantially along line 5—5 of FIG. 4.

As illustrated in FIGS. 3 and 4, the foot protector 12 of the present invention desirably includes a heel portion 16, which preferably includes a high splice heel region 16*a*, a medial heel region 16*b*, and a low splice heel region 16*c*. The foot protector also desirably includes a reciprocatorily knit toe portion 22, an integrally knit arch portion 18, and an instep portion The low splice heel portion 16*c*, arch portion 18, and a lower portion of the toe portion 22 define a lower sole, shown generally at 23, which preferably encompasses substantially a lower one-half of the circumference of the foot protector 12. The instep portion 24 preferably encompasses substantially the upper one-half circumference of the foot protector 12. The opposite side edges of the instep portion 24 are joined to the lower sole portion by way of longitudinally extending, opposing side panels 26*a*, 26*b*. The longitudinally extending side panels 26*a*, 26*b* preferably extend from the toe portion 22 to a top portion 28 of the foot protector.

The top portion 28 extends upwardly from the instep 24 and heel 16 portions and is adapted to encircle the wearer's foot proximate the wearer's ankle A. The top portion 28 is formed to have a relatively small longitudinal length as it extends from the instep portion 24 and heel portion 16 of the foot protector, in order that it terminates proximate or below the ankle. Because of its relatively small length, the top portion 28 thus assists in the securement of the foot protector about the wearer's foot, while minimizing its appearance above the upper edge of the wearer's shoe S. As illustrated in FIGS. 6–11, the top portion 28 preferably has a first section 28*a* proximate the instep portion of the foot protector, and a second section 28*b* proximate the heel portion of the foot protector. The first section 28*a* has a length L1 and the second section 28*b* has a length L2, and the length of the first section is less than the length of the second section so that the top portion 28 has an extended length proximate the wearer's upper heel when the foot protector 12 is positioned on a wearer's foot. As illustrated in FIGS. 6–7 and 8–9, when the foot protector is positioned on the wearer's foot, the section 28*b* proximate the wearer's heel extends to a greater extent upwards on the wearer's foot than the section 28*a* corresponding to the front of the foot.

Figure 7:
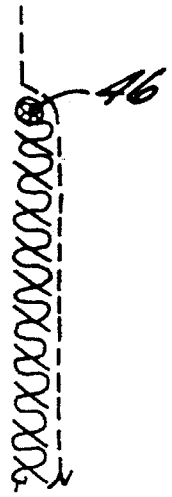
FIG. 7 illustrates an enlarged cross-sectional view of a top portion of a foot protector according to the present invention taken substantially along line 7—7 of FIG. 6.
Figure 8:
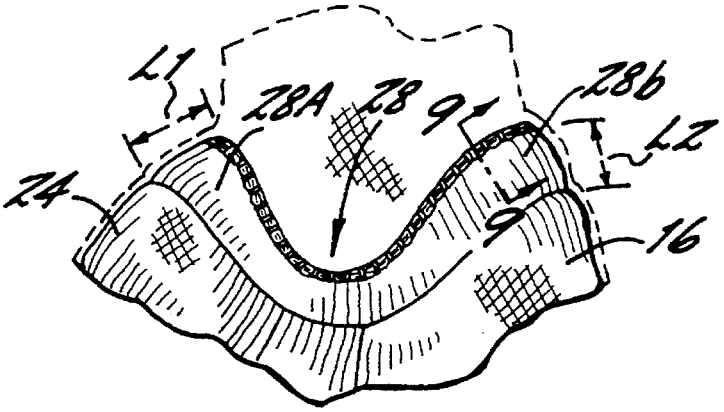
FIG. 8 illustrates a fragmentary view of an embodiment of a foot protector according to the present invention.
Figure 9:
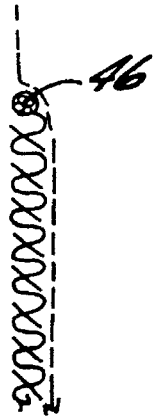
FIG. 9 illustrates an enlarged cross-sectional view of a top portion of a foot protector according to the present invention taken substantially along line 9—9 of FIG. 8.

As illustrated in FIGS. 7 and 9, the top portion 28 preferably includes one or more elastic threads 46 at its terminal end, which further assists in securing the top portion of the foot protector 12 about a wearer's foot. The top portion 28 is preferably plain knit with its technical face forming what is to be the outer surface of the foot protector 12 (i.e. the side opposite the wearer-contacting surface.) This is preferably also the opposite side of the foot protector from that which has the padding thereon, as will be discussed further herein. Because of the natural tendency of the plain knit fabric to curl toward its technical face, the top portion of this embodiment tends to curl outwardly and roll up on itself prior to donning the foot protector on the foot. Once the foot protector is donned, however, the different lengths L1 and L2 of the first and second sections, respectively, the unpadded construction of the top portion 28, and the elastic threads 46 all cooperate to maintain the foot protector on the wearer's foot in a substantially unrolled position. This unique construction enables the foot protector to be sufficiently low cut such that it is not readily visible above the top of the wearer's shoe S, while staying in its desired position on the foot without creeping downward. This is particularly important because were the foot protector to creep downwardly while in wear beneath stocking-type hosiery, it could be difficult to pull the foot protector back into proper position without removing the hosiery. Further, the foot protector 12 is also prevented from downward shifting during wear about the instep portion 24 of the wearer's foot by the first section 28A of the top portion 28, which tends to abut the shoe S and prevent foot protector shifting. This enhances the comfort of the foot protector 12 on the wearer's foot, while minimizing its appearance.

The foot protector 12 also desirably includes padding of varying thicknesses in selected locations in order to cushioningly protect the wearer's feet. A first thickness of padding P1 is preferably provided on the toe 22, ball 20 and heel 16 portions of the foot protector 12. A second thickness of padding P2 is preferably provided on the instep 24 and arch 18 portions of the foot protector. Because the toe, ball and heel portions of a wearer's feet tend to receive the greatest amount of force and wear, the first thickness of padding P1 is preferably thicker than the second thickness P2, in order to provide a greater degree of protection to those areas which can most greatly benefit from the added protection. Additionally, because the side portions of a wearer's feet generally experience the least amount of deleterious forces, the side panels 26A, 26B are desirably left relatively unpadded as compared to the other areas. Further, the top portion 28 of the foot protector 12 is left unpadded in order that its appearance is minimized when it is worn underneath stocking-type hosiery 14, while having sufficient bulk to enable it to maintain the foot protector in its desired position on the wearer's foot in the manner discussed above. It will also be understood by those skilled in the art, however, that other types of thickened padding may also be provided according to the present invention, such as pads stitched or otherwise secured to the foot protector 12.

The padding P1, P2 is preferably provided in the form of terry loops which are formed in the knit structure of the foot protector 12. The number of loops, number of yarns forming the loops, loop length, loop compactness, and the like, can be selected to provide an optimal amount of padding in the respective padded portions of the foot protector 12. The foot protector 12 is preferably knit so that a first body yarn 30 is knit throughout substantially the entire foot protector, with auxiliary yarns being fed in selected locations. The body yarn 30 is desirably a stretch yarn, such as stretch nylon or the like, and the auxiliary yarns 32, 34 preferably form terry loops in the regions of the foot protector which are to be padded.

In a preferred form of the invention, the foot protector 12 is knit on conventional sock-making machinery as follows: the toe portion 22, ball 20 and heel 16 portions of the foot protector are knit from a body yarn 30 while first and second auxiliary yarns 34, respectively, are fed in to form terry loops in those regions, to thereby produce padded regions having a first thickness P1. The arch 18 and instep 24 portions of the foot protector 12 are knit using a single auxiliary yarn 32 which forms terry loops in those regions in order that those regions have a second padding thickness P2, which is thinner than those regions which have two auxiliary yarns forming the terry regions. The side panels 26A, 26B and top portion 28 are knit from the body yarn 30 and a first auxiliary yarn 32 which is knit in the same form as the body yarn rather than forming terry loops as it does in the padded regions P1, P2 of the foot protector As mentioned above, the body yarn 30 is preferably nylon or a composite yarn such as a spandex core/nylon covered yarn. The auxiliary yarns are desirably acrylic or nylon. As will readily be recognized, however, different kinds of yarns can be used to form the various portions in order to enhance the functional properties of the foot protector, such as durability and moisture absorption. For example, at least one of the yarns can be selected to be hydrophilic in order to enhance the absorption of perspiration from a wearer's foot. Similarly, the color of the yarns used can be varied according the desires of the intended wearer, but the color is preferably selected to minimize the appearance of the foot protector beneath stocking-type hosiery articles.

Figure 6:
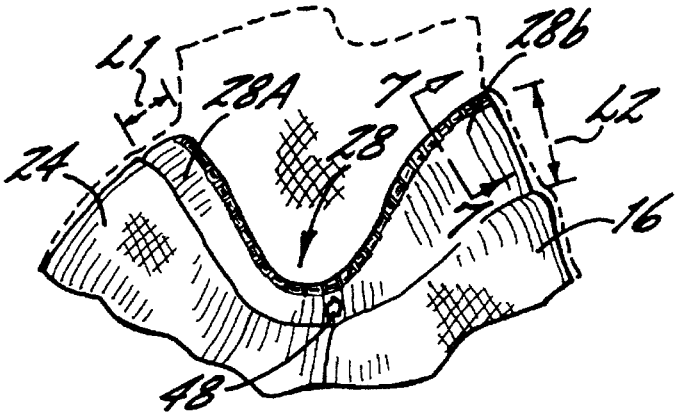
FIG. 6 illustrates a fragmentary view of an embodiment of a foot protector according to the present invention.

As discussed above, the top portion 28 of the foot protector 12 is desirably knit so that the second section 28B which extends from the heel portion 16 of the foot protector 12 has a greater length L2 than the length L1 of the first section 28A which corresponds to the instep portion 24 of the foot protector. This can be achieved by knitting a greater number of top portion-forming courses along the heel portion 16 of the foot protector 12 than on the instep portion 24. As illustrated in FIG. 6, the transition between the different number of courses about these sections can be performed in a smooth and easy manner through the provision of a "birds-eye" 48 at each of the course number transition points located on opposite sides of the foot protector. Such birds-eye structures are known to those of skill in the knitting art, and thus will not be discussed further herein. The toe portion of the foot protector is then closed in a conventional manner, such as by sewing the toe to the instep portion along a seam.

In the drawings and specification, there have been disclosed typical preferred embodiments of the invention and, although specific terms are employed, these terms are used in a descriptive sense only and not for purposes of limitation. The invention has been described in considerable detail with specific reference to various illustrated embodiments. It will be apparent, however, that various modifications and changes can be made within the spirit and scope of the invention as described in the foregoing specification and defined in the appended claims.

That which is claimed:

1. A footlet type foot protector comprising:

a foot portion including toe, ball, arch, heel and instep portions for covering the respective portions of a wearer's foot, a top portion extending upwardly from said heel and instep portions of said foot portion for encircling a wearer's foot adjacent his ankle, said top portion having a first upwardly extending length proximate the instep portion of the foot portion and a second upwardly extending length proximate the heel portion of said foot portion, said second length being greater than said first length, and padding positioned only on said foot portion, said top portion being substantially unpadded.

2. The foot protector according to claim 1, wherein said padding is in the form of terry loops.

3. The foot protector according to claim 2, wherein said terry loops are located on an inner surface of said foot portion and said top portion has a tendency to roll onto itself in a direction away from said inner surface.

4. The foot protector according to claim 1, wherein said padding is located on said ball and heel portions of said foot portion.

5. The foot protector according to claim 1, wherein said padding comprises a first pad type having a first thickness and a second pad type having a second thickness which is greater than said first thickness, said first pad type being located on said toe, ball, and heel portions and said second pad type being located on said instep and arch portions of said foot portion.

6. The foot protector according to claim 1, wherein said heel and instep portions are joined along first and second side panels which extend along the length of the foot protector, the first and second side panels being substantially unpadded, to thereby minimize the bulk of the foot protector.

7. A knit footlet type foot protector comprising:

a foot portion including at least heel and instep portions for covering the respective portions of a foot, wherein said heel and instep portions are joined along first and second side panels and at least a section of the heel portion includes a terry yarn knit therein, and a top portion extending upwardly from the heel and instep portions for encircling a wearer's foot adjacent his ankle, said top portion having a first upwardly extending length proximate the instep portion of the foot portion and a second upwardly extending length proximate the heel portion of said foot portion, wherein said top portion has a non-terry surface and said second length is greater than said first length.

8. A method of protecting a foot while wearing stocking-type hosiery comprising:

providing a foot protector having a foot portion including at least padded instep and heel portions and a top portion having a first upwardly extending length proximate the instep portion and a second upwardly extending length proximate the heel portion, wherein the second length is greater than the first length positioning said foot protector on the foot and positioning a stocking on the foot in layered relationship to the foot protector.

9. The method according to claim 8, wherein the stocking is knit from approximately 20–140 denier yarns.

10. The method according to claim 8, wherein said top portion terminates proximate the ankle of the foot.

11. The method according to claim 8, wherein said foot protector is positioned so as to intimately contact skin and said stocking is positioned over said foot protector.

12. The method according to claim 8, wherein the top portion of the foot protector is substantially unpadded.

13. A method if providing comfort to a foot while maintaining an aesthetically appealing appearance comprising:

providing a foot protector having a foot portion including heel and instep portions and including padding thereon for cushioning the foot and an unpadded top portion, said unpadded top portion extending upwardly from said foot portion a greater distance proximate said heel portion than said instep portion and sized to terminate proximate to or beneath an ankle region, donning an item of stocking-type hosiery in a one-over-the-other layered arrangement on the feet to thereby provide cushioning protection to the feet, while maintaining the appearance of wearing stockings alone.

14. The method according to claim 13, wherein said step of donning the foot protector and item of stocking-type hosiery in a one-over-the-other layered arrangement comprises donning the item of stocking-type hosiery over the foot protector so that the foot protector is closer to the wearer's foot than the item of stocking-type hosiery.

15. A stocking and foot protector combination comprising:

a foot protector having a foot portion including toe, ball, arch, heel and instep portions for covering the respective portions of a wearer's foot, a top portion extending upwardly from said heel and instep portions of said foot portion for encircling a wearer's foot adjacent his ankle, said top portion having a first upwardly extending length proximate the instep portion of the foot portion and a second upwardly extending length proximate the heel portion of said foot portion, said second length being greater than said first length and said first and second lengths being sized to terminate proximate or below an ankle, padding positioned only on said foot portion, said top portion being substantially unpadded, and an item of stocking-type hosiery surrounding an outer surface of said foot protector, said item of stocking-type hosiery including a leg portion which is sized to extend beyond the top portion of the foot protector to cover a portion of a leg.

16. A stocking and foot protector combination according to claim 15, wherein said padding is in the form of terry loops.

17. The foot protector according to claim 16, wherein said terry loops are located on an inner surface of said foot portion and said top portion has a tendency to roll onto itself in a direction away from said inner surface.

18. The foot protector according to claim 15, wherein said padding is located on said ball and heel portions of said foot portion.

19. The foot protector according to claim 15, wherein said padding comprises a first pad type having a first thickness and a second pad type having a second thickness which is greater than said first thickness, said first pad type being located on said toe, ball, and heel portions and said second pad type being located on said instep and arch portions of said foot portion.

20. The foot protector according to claim 15, wherein said heel and instep portions are joined along first and second side panels which extend along the length of the foot protector, the first and second side panels being substantially unpadded, to thereby minimize the bulk of the foot protector.

21. A method of making a foot protector comprising:

knitting a series of courses to define a foot portion including heel, arch, ball, toe, and instep portions, forming padding on selected portions of said foot portion, and knitting a series of courses to said foot portion to define a tubular top portion which extends upwardly from the heel and instep portions of said foot portion such that a second section of said top portion extending upwardly from said heel portion of the foot portion has a greater upward-extending length than a first section extending upwardly from said instep portion, and such that the top portion is substantially unpadded.

22. The method according to claim 21, further comprising knitting in a reciprocating manner which forms a birds-eye at respective junctures of the first and second sections of said top portion.

* * * * *